US007882905B2

(12) United States Patent
Radford et al.

(10) Patent No.: US 7,882,905 B2
(45) Date of Patent: Feb. 8, 2011

(54) STABILIZER AND REAMER SYSTEM HAVING EXTENSIBLE BLADES AND BEARING PADS AND METHOD OF USING SAME

(75) Inventors: Steven R. Radford, The Woodlands, TX (US); Les T. Shale, Willis, TX (US)

(73) Assignee: Baker Hughes Incorporated, Houston, TX (US)

( * ) Notice: Subject to any disclaimer, the term of this patent is extended or adjusted under 35 U.S.C. 154(b) by 179 days.

(21) Appl. No.: 12/058,384

(22) Filed: Mar. 28, 2008

(65) Prior Publication Data

US 2009/0242275 A1 Oct. 1, 2009

(51) Int. Cl.
*E21B 10/32* (2006.01)

(52) U.S. Cl. ..... 175/291; 175/76

(58) Field of Classification Search ..... 175/57, 175/76, 269, 273, 291, 325.1
See application file for complete search history.

(56) References Cited

U.S. PATENT DOCUMENTS

| | | | |
|---|---|---|---|
| 1,548,578 | A | 8/1925 | Blanchard |
| 1,678,075 | A | 7/1928 | Phipps |
| 1,772,710 | A | 8/1930 | Denney |
| 1,804,850 | A | 5/1931 | Triplett |
| 2,069,482 | A | 2/1937 | Seay |
| 2,177,721 | A | 10/1939 | Johnson et al. |
| 2,344,598 | A | 3/1944 | Church |
| 2,758,819 | A | 8/1956 | Kammerer, Jr. et al. |
| 2,799,479 | A | 7/1957 | Kammerer |
| 2,882,019 | A | 4/1959 | Carr et al. |

(Continued)

FOREIGN PATENT DOCUMENTS

| | | | |
|---|---|---|---|
| EP | 0594420 | A1 | 4/1994 |

(Continued)

OTHER PUBLICATIONS

Radford, Steven, et al., "Novel Concentric Expandable Stabilizer Results in Increased Penetration Rates and Drilling Efficiency with Reduced Vibration," SPE/IADC 119534, prepared for presentation at the SPE/IADC Drilling Conference and Exhibition held in Amsterdam, The Netherlands, Mar. 17-19, 2009, 13 pages.

(Continued)

*Primary Examiner*—Daniel P Stephenson
(74) *Attorney, Agent, or Firm*—TraskBritt

(57) ABSTRACT

Drilling systems and methods for enlarging a borehole that include an expandable reamer and an expandable stabilizer axially coupled above the expandable reamer are disclosed. The expandable reamer includes a tubular body having a longitudinal axis and a drilling fluid flow path therethrough, a plurality of generally radially and longitudinally extending blades carried by the tubular body, and a cutting structure carried by at least one blade of the plurality of blades, wherein at least one blade of the plurality of blades is movable outwardly with respect to the longitudinal axis. The expandable stabilizer includes a tubular body having a longitudinal axis and a drilling fluid flow path therethrough, a plurality of generally radially and longitudinally extending bearing pads carried by the tubular body, wherein at least one bearing pad of the plurality of bearing pads includes an up-hole cutting structure carried thereupon and is movable outwardly with respect to the longitudinal axis.

22 Claims, 3 Drawing Sheets

U.S. PATENT DOCUMENTS

| | | | |
|---|---|---|---|
| 3,105,562 | A | 10/1963 | Stone et al. |
| 3,123,162 | A | 3/1964 | Rowley |
| 3,126,065 | A | 3/1964 | Chadderdon |
| 3,211,232 | A | 10/1965 | Grimmer |
| 3,320,004 | A | 5/1967 | Garrett |
| 3,332,498 | A | 7/1967 | Page, Jr. |
| 3,433,313 | A | 3/1969 | Brown |
| 3,753,471 | A | 8/1973 | Kammerer, Jr. et al. |
| 3,845,815 | A | 11/1974 | Garwood |
| 3,916,998 | A | 11/1975 | Bass, Jr. et al. |
| 4,055,226 | A | 10/1977 | Weber |
| 4,111,262 | A | 9/1978 | Duncan |
| 4,304,311 | A | 12/1981 | Shinn |
| 4,440,222 | A | 4/1984 | Pullin |
| 4,456,080 | A | 6/1984 | Holbert |
| 4,458,761 | A | 7/1984 | Van Vreeswyk |
| 4,540,941 | A | 9/1985 | Walkow |
| 4,565,252 | A | 1/1986 | Campbell et al. |
| 4,635,738 | A | 1/1987 | Schillilnger |
| 4,660,657 | A | 4/1987 | Furse et al. |
| 4,711,326 | A | 12/1987 | Baugh et al. |
| 4,842,083 | A | 6/1989 | Raney |
| 4,877,092 | A | 10/1989 | Helm et al. |
| 4,889,197 | A | 12/1989 | Boe |
| 5,139,098 | A | 8/1992 | Blake |
| 5,175,429 | A | 12/1992 | Hall, Jr. et al. |
| 5,211,241 | A | 5/1993 | Mashaw, Jr. et al. |
| 5,265,684 | A | 11/1993 | Rosenhauch |
| 5,293,945 | A | 3/1994 | Rosenhauch et al. |
| 5,305,833 | A | 4/1994 | Collins |
| 5,318,131 | A | 6/1994 | Baker |
| 5,318,137 | A | 6/1994 | Johnson et al. |
| 5,318,138 | A | 6/1994 | Dewey et al. |
| 5,332,048 | A | 7/1994 | Underwood et al. |
| 5,343,963 | A | 9/1994 | Bouldin et al. |
| 5,368,114 | A | 11/1994 | Tandberg et al. |
| 5,375,662 | A | 12/1994 | Echols, III et al. |
| 5,402,856 | A | 4/1995 | Warren et al. |
| 5,402,859 | A | 4/1995 | Boberg et al. |
| 5,413,180 | A | 5/1995 | Ross et al. |
| 5,437,308 | A | 8/1995 | Morin et al. |
| 5,443,129 | A | 8/1995 | Bailey et al. |
| 5,495,899 | A | 3/1996 | Pastusek et al. |
| 5,497,842 | A | 3/1996 | Pastusek et al. |
| 5,518,073 | A | 5/1996 | Manke et al. |
| 5,558,162 | A | 9/1996 | Manke et al. |
| 5,560,440 | A | 10/1996 | Tibbitts |
| 5,647,437 | A | 7/1997 | Braddick et al. |
| 5,740,864 | A | 4/1998 | De Hoedt et al. |
| 5,746,274 | A | 5/1998 | Voll et al. |
| 5,765,653 | A | 6/1998 | Doster et al. |
| 5,788,000 | A | 8/1998 | Maury et al. |
| 5,823,254 | A | 10/1998 | Dobson et al. |
| 5,853,054 | A | 12/1998 | McGarian et al. |
| 5,862,870 | A | 1/1999 | Hutchinson |
| 5,957,223 | A | 9/1999 | Doster et al. |
| 5,992,518 | A | 11/1999 | Whitlock |
| 6,059,051 | A | 5/2000 | Jewkes et al. |
| 6,070,677 | A | 6/2000 | Johnston, Jr. |
| RE36,817 | E | 8/2000 | Pastusek et al. |
| 6,131,662 | A | 10/2000 | Ross |
| 6,131,675 | A | 10/2000 | Anderson |
| 6,179,066 | B1 | 1/2001 | Nasr et al. |
| 6,213,226 | B1 | 4/2001 | Eppink et al. |
| 6,227,312 | B1 | 5/2001 | Eppink et al. |
| 6,289,999 | B1 | 9/2001 | Dewey et al. |
| 6,325,151 | B1 | 12/2001 | Vincent et al. |
| 6,328,117 | B1 | 12/2001 | Berzas et al. |
| 6,360,831 | B1 | 3/2002 | Akesson et al. |
| 6,378,632 | B1 | 4/2002 | Dewey et al. |
| 6,494,272 | B1 | 12/2002 | Eppink et al. |
| 6,499,537 | B1 | 12/2002 | Dewey et al. |
| 6,615,933 | B1 | 9/2003 | Eddison |
| 6,651,756 | B1 | 11/2003 | Costo, Jr. et al. |
| 6,668,936 | B2 | 12/2003 | Williamson, Jr. et al. |
| 6,668,949 | B1 | 12/2003 | Rives |
| 6,695,080 | B2 | 2/2004 | Presley et al. |
| 6,702,020 | B2 | 3/2004 | Zachman et al. |
| 6,732,817 | B2 | 5/2004 | Dewey et al. |
| 6,739,416 | B2 | 5/2004 | Presley et al. |
| 6,880,650 | B2 | 4/2005 | Hoffmaster et al. |
| 6,886,633 | B2 | 5/2005 | Fanuel et al. |
| 6,920,930 | B2 | 7/2005 | Allamon et al. |
| 6,920,944 | B2 | 7/2005 | Eppink et al. |
| 6,991,046 | B2 | 1/2006 | Fielder et al. |
| 7,021,389 | B2 | 4/2006 | Bishop et al. |
| 7,036,611 | B2 | 5/2006 | Radford et al. |
| 7,048,078 | B2 | 5/2006 | Dewey et al. |
| 7,069,775 | B2 | 7/2006 | Fredette et al. |
| 7,083,010 | B2 | 8/2006 | Eppink et al. |
| 7,100,713 | B2 | 9/2006 | Tulloch |
| 7,234,542 | B2 | 6/2007 | Vail, III |
| 7,252,163 | B2 | 8/2007 | Ollerenshaw et al. |
| 7,287,603 | B2 | 10/2007 | Hay et al. |
| 7,293,616 | B2 | 11/2007 | Tulloch |
| 7,308,937 | B2 | 12/2007 | Radford et al. |
| 7,314,099 | B2 | 1/2008 | Dewey et al. |
| 7,325,630 | B2 | 2/2008 | Takhaundinov et al. |
| 7,451,836 | B2 | 11/2008 | Hoffmaster et al. |
| 7,493,971 | B2 | 2/2009 | Nevlud et al. |
| 7,506,703 | B2 | 3/2009 | Campbell et al. |
| 7,513,318 | B2 | 4/2009 | Underwood et al. |
| 7,549,485 | B2 | 6/2009 | Radford et al. |
| 7,658,241 | B2 | 2/2010 | Lassoie et al. |
| 2003/0155155 | A1* | 8/2003 | Dewey et al. ..... 175/57 |
| 2004/0134687 | A1 | 7/2004 | Radford et al. |
| 2005/0145417 | A1 | 7/2005 | Radford et al. |
| 2005/0241856 | A1 | 11/2005 | Lassoie et al. |
| 2005/0274546 | A1 | 12/2005 | Fanuel et al. |
| 2005/0284659 | A1 | 12/2005 | Hall et al. |
| 2006/0113113 | A1 | 6/2006 | Underwood et al. |
| 2006/0118339 | A1 | 6/2006 | Takhaundinov et al. |
| 2006/0124317 | A1 | 6/2006 | Telfer |
| 2006/0144623 | A1 | 7/2006 | Ollerensaw et al. |
| 2006/0207801 | A1 | 9/2006 | Clayton |
| 2006/0249307 | A1 | 11/2006 | Ritter et al. |
| 2007/0089912 | A1 | 4/2007 | Eddison et al. |
| 2008/0105464 | A1 | 5/2008 | Radford |
| 2008/0110678 | A1 | 5/2008 | Radford et al. |
| 2008/0128169 | A1 | 6/2008 | Radford et al. |
| 2008/0128174 | A1 | 6/2008 | Radford et al. |
| 2008/0128175 | A1 | 6/2008 | Radford et al. |
| 2009/0145666 | A1 | 6/2009 | Radford et al. |
| 2009/0242277 | A1 | 10/2009 | Radford et al. |

FOREIGN PATENT DOCUMENTS

| | | | |
|---|---|---|---|
| EP | 0594420 | B1 | 4/1994 |
| EP | 1188898 | A2 | 3/2002 |
| EP | 1614852 | | 1/2006 |
| GB | 2420803 | A | 6/2006 |
| GB | 2393461 | B | 10/2006 |
| GB | 2426269 | B | 2/2007 |
| RU | 2172385 | | 3/2000 |
| WO | 2007017651 | | 2/2007 |

OTHER PUBLICATIONS

International Search Report for International Application No. PCT/US2009/038194, mailed Nov. 9, 2009.

U.S. Appl. No. 12/501,688, filed Jul. 13, 2009, entitled "Stabilizer Ribs on Lower Side of Expandable Reamer Apparatus to Reduce Operating Vibration," by Redford et al.

International Search Report for PCT/US2007/024796, dated Jul. 11, 2008, 7 pages.

Written Opinion of the International Searching Authority for PCT/US2007/024796, dated Jul. 11, 2008, 10 pages.
PCT International Search Report for International Application No. PCT/US2007/024795, mailed May 28, 2008.
U.S. Appl. No. 12/416,386, filed Apr. 1, 2009, entitled "Compound Engagement Profile on a Blade of a Down-Hole Stabilizer and Methods Therefor," by Steven R. Radford.
PCT International Search Report for International Application No. PCT/US2009/042511, mailed Dec. 1, 2009.
Merriam-Webster Dictionary, Definitions of "Retain" and "Keep" accessed May 20, 2010 from www.merriam-webster.com.
International Search Report for International Application No. PCT/US2010/025867 mailed Oct. 15, 2010, 3 pages.
International Written Opinion for International Application No. PCT/US2010/025867 mailed Oct. 15, 2010, 6 pages.

* cited by examiner

STABILIZER AND REAMER SYSTEM HAVING EXTENSIBLE BLADES AND BEARING PADS AND METHOD OF USING SAME

CROSS-REFERENCE TO RELATED APPLICATIONS

The present application is related to U.S. patent application Ser. No. 11/949,405, filed Dec. 3, 2007, entitled Restriction Element Trap for Use with an Actuation Element of a Downhole Apparatus and Method of Use, pending; U.S. patent application Ser. No. 11/949,259, filed Dec. 3, 2007, entitled Expandable Reamers for Earth Boring Applications, pending, which is a non-provisional of U.S. patent application Ser. No. 60/872,744, filed Dec. 4, 2006; and U.S. patent application Ser. No. 12/501,688, filed Jul. 13, 2009, entitled Stabilizer Ribs on Lower Side of Expandable Reamer Apparatus to Reduce Operating Vibration, pending, each of which is assigned to the Assignee of the present application.

Technical Field

Embodiments of the present invention relate generally to a system for drilling a subterranean borehole and, more particularly, to a stabilizer and reamer system having extensible blades and bearing pads for enlarging a subterranean borehole beneath a casing or liner, and including methods of use therefor.

Background

Expandable reamers are typically employed for enlarging subterranean boreholes. Conventionally in drilling oil, gas, and geothermal wells, casing is installed and cemented to prevent the well bore walls from caving into the subterranean borehole while also providing requisite shoring for subsequent drilling operation to achieve greater depths. Casing is also conventionally installed to mutually isolate different formations, to prevent crossflow of formation fluids, and to enable control of formation fluids and pressure as the borehole is being drilled. To increase the depth of a previously drilled borehole, new and smaller diameter casing (such term including liner) is disposed within and extended below the previous casing. However, while adding additional casing allows a borehole to reach greater depths, the additional, smaller casing has the disadvantage of narrowing the borehole. Narrowing the borehole restricts the diameter of any subsequent sections of the well because the drill bit and any further casing must pass through the smaller casing. As reductions in the borehole diameter are undesirable because they limit the production flow rate of oil and gas through the borehole, it is often desirable to enlarge a subterranean borehole to provide a larger borehole diameter beyond previously installed casing to enable better production flow rates of hydrocarbons through the borehole.

A variety of approaches have been employed for enlarging a borehole diameter. One conventional approach used to enlarge a subterranean borehole includes using eccentric and bi-center bits. For example, an eccentric bit with a laterally extended or enlarged cutting portion is rotated about its axis to produce an enlarged borehole diameter. An example of an eccentric bit is disclosed in U.S. Pat. No. 4,635,738, assigned to the assignee of the present invention. A bi-center bit assembly employs two longitudinally superimposed bit sections with laterally offset axes, which when rotated produce an enlarged borehole diameter. An example of a bi-center bit is disclosed in U.S. Pat. No. 5,957,223, which is also assigned to the assignee of the present invention.

Another conventional approach used to enlarge a subterranean borehole includes employing an extended bottom hole assembly with a pilot drill bit at the distal end thereof and a reamer assembly located at a proximal distance above. This arrangement permits the use of any conventional rotary drill bit type, be it a rock bit or a drag bit, as the pilot bit, and the associated extended nature of the assembly permit greater flexibility when passing through tight spots in the borehole, as well as the opportunity to effectively stabilize the pilot drill bit so that the pilot hole and the following reamer will traverse the path intended for the borehole. This aspect of an extended bottom hole assembly is particularly significant in directional drilling. The assignee of the present invention has, to this end, designed reaming structures as so called "reamer wings," which generally comprise a tubular body having a fishing neck with a threaded connection at the top thereof and a tong die surface at the bottom thereof, also with a threaded connection. U.S. Pat. Nos. 5,497,842 and 5,495,899, both assigned to the assignee of the present invention, disclose reaming structures including reamer wings. The upper mid-portion of the reamer wing tool includes one or more longitudinally extending blades projecting generally radially outwardly from the tubular body, the outer edges of the blades carrying PDC cutting elements.

As mentioned above, conventional expandable reamers may be used to enlarge a subterranean borehole and may include blades pivotably or hingedly affixed to a tubular body and actuated by way of a piston disposed therein as disclosed by U.S. Pat. No. 5,402,856 to Warren. In addition, U.S. Pat. No. 6,360,831 to Åkesson et al. discloses a conventional borehole opener comprising a body equipped with at least two hole opening arms having cutting means that may be moved from a position of rest in the body to an active position by exposure to pressure of the drilling fluid flowing through the body. The blades in these reamers are initially retracted to permit the tool to be run through the borehole on a drill string and once the tool has passed beyond the end of the casing, the blades are extended so the well bore diameter may be increased below the casing.

The blades of these conventional expandable reamers utilize pressure from inside the tool to apply force radially outward against pistons which move the blades, carrying cutting elements, laterally outward. Still other conventional reamers utilize pressure from inside the tool to apply force axially against a piston which forces attached blades, carrying cutting elements, laterally outward. Still further, fluid and pressure operated expandable reamers are disclosed in U.S. patent application Ser. Nos. 11/875,241, now U.S. Pat. No. 7,721,823, issued May 25, 2010, 11/873,346, now U.S. Pat. No. 7,594,522, issued Sep. 29, 2009, 11/949,259, currently pending, and 11/949,627, currently pending, each of which is assigned to the assignee of the present invention and the disclosure of each of which application is incorporated herein in its entirety by this reference, overcome some of the difficulties associated with conventional expandable reamers while providing for enhanced lateral movement of the blades.

Various approaches to drill and/or ream a larger diameter borehole below a smaller diameter borehole may include stabilizer blocks or pads used longitudinally above or below an expandable reamer to increase stability and reduce dysfunctional loads, i.e., lateral vibrational loading, thereupon while reaming. Use of stabilizers to improve the drilling performance of an expandable reamer is generally known to a person of ordinary skill in the art. In most instances, fixed stabilizer pads or blocks, being sized and configured for a corresponding hole diameter cut by a pilot bit or drill bit, are located in a drill string between the bit and the expandable reamer. It is recognized that an expandable reamer may be run through a borehole without a pilot bit or drill bit, particularly when reaming or expanding an existing borehole. The stabilizer pads or blocks help to control stability, particularly when conducting a so called "down drill" operation, e.g. drilling in the down-hole direction. Also, as understood by a person of skill in the art, stability is further improved by providing a point of control above an expandable reamer to decrease the flexibility of the drill string about the expandable reamer. In this respect, an expandable reamer may include, when used in "down drill" operations, expandable stabilizer blocks or pads above the reamer. The expandable stabilizer blocks or pads are also known as expandable stabilizers, such as the movable bearing pad structure disclosed in U.S. patent application Ser. No. 11/875,241 referenced above, such apparatus being operated to an expanded state by the flow of fluid, such as drill mud, or pressure within the drill string. The expandable stabilizer blocks or pads may also be included in the drill string below the expandable reamer, either by replacing or augmenting the function of the fixed stabilizer pads or blocks. The expandable reaming blocks or pads, when placed above an expandable reamer, are conventionally sized and configured to extend to a diameter corresponding to the reamed borehole diameter.

The fixed and expandable stabilizer blocks or pads may be integral with a tool body of an expandable reamer or may be included with other down-hole tools serially connected above and/or below an expandable reamer, such as part of a drill bit or a stabilizer tool. The expandable reamers and the expandable stabilizers, operated by the flow of fluid or pressure within respective flow bores, overcome some of the limitations associated with bi-center and reamer wing assemblies in the sense that the pass-through diameter of such tools is nonadjustable and limited by the reaming diameter; and improves upon the tendency associated with conventional bi-center and eccentric bits to wobble and deviate from the path intended for the borehole. Moreover, the fluid or pressure operated expandable reamers and expandable stabilizers may overcome other limitations associated with conventional expandable reaming assemblies, such as being subject to damage when passing through a smaller diameter borehole or casing section, becoming prematurely actuated, and difficulties in removal through the casing after actuation.

Notwithstanding the various prior approaches to drill and/or ream a larger diameter borehole below a smaller diameter borehole, a need exists for improved apparatus, systems or methods for doing so. For instance, conventional systems for stabilizing while reaming a borehole (especially while back reaming a drilled borehole) may encounter subterranean formation changes within the formation of the drilled borehole (i.e., a tight spot of swelled shale or filter cake in the formation, or other obstructions) making retraction of the stabilizer and reamer necessary, while trimming or back reaming, this being undesirable in that an under-gage borehole results. Thus, encountering changes in the previously reamed formation may necessitate deactivation (retraction) of an expandable reamer and stabilizer in order to trip back up the borehole and, then begin reaming, again, in the down-hole direction in order to trim the borehole to the proper diameter.

Accordingly, there is an ongoing desire to improve or extend performance of a stabilizer and reamer system having extensible blades and bearing pads for enlarging a subterranean borehole beneath a casing, including a method of use therefor. There is a further desire to provide a stabilizer and reamer system having extensible blades and bearing pads capable of trimming a reamed or drilled borehole in the up-hole direction, particularly during a so called "up drill" or "back ream" operation, while improving stabilization of the bottom hole assembly.

BRIEF SUMMARY OF THE INVENTION

In order to prevent sticking of an expandable stabilizer during upward movement in a borehole, or for enabling a reamed or drilled borehole to be trimmed more efficiently in the up-hole direction while simultaneously providing reduced lateral vibration in the bottom hole assembly, drilling systems and methods for enlarging a borehole are provided.

The invention relates generally to a system for drilling a subterranean borehole and, more particularly, to apparatus having both extensible blades and bearing pads, and methods of use thereof, for enlarging a subterranean borehole below a restriction, such as casing or liner. Furthermore, the invention relates to improved methods and apparatus for improving stabilization of a drilling assembly while under-reaming in either the down-hole or up-hole directions and controlling directional tendencies and reducing undesirable vibrational effects of the drilling assembly within an enlarged borehole. Moreover, the invention provides up-hole cutting structures upon the bearing pads of an extensible stabilizer for trimming a previously enlarged subterranean borehole, particularly when so called "back reaming" of the enlarged borehole is desired and when the bearing pads of extensible stabilizer are expanded to the same lateral extent as the extensible blades of the expandable reamer.

In accordance with an embodiment of the invention, a drilling system for enlarging a borehole includes an expandable reamer and an expandable stabilizer axially coupled above the expandable reamer. The expandable reamer includes a tubular body having a longitudinal axis and a drilling fluid flow path therethrough, a plurality of generally radially and longitudinally extending blades carried by the tubular body, and a cutting structure carried by at least one blade of the plurality of blades, wherein at least one blade of the plurality of blades is movable outwardly, with respect to the longitudinal axis. The expandable stabilizer includes a tubular body having a longitudinal axis and a drilling fluid flow path therethrough, a plurality of generally radially and longitudinally extending bearing pads carried by the tubular body, wherein at least one bearing pad of the plurality of bearing pads includes an up-hole cutting structure carried thereupon and is movable outwardly with respect to the longitudinal axis.

According to other embodiments of the invention, a drilling system for enlarging a borehole in a subterranean formation is provided. The drilling system includes an expandable reamer comprising a tubular body having a longitudinal axis and a drilling fluid flow path therethrough, a plurality of generally radially and longitudinally extending blades carried by the tubular body, and a cutting structure carried by at least one blade of the plurality of blades, wherein at least one blade of the plurality of blades is movable outwardly with respect to the longitudinal axis. The drilling system also includes an expandable stabilizer axially coupled above the expandable reamer and comprising a tubular body having a longitudinal axis and extending the drilling fluid flow path therethrough, a plurality of generally radially and longitudinally extending bearing pads carried by the tubular body, wherein at least one bearing pad of the plurality of bearing pads includes up-hole cutting structure carried thereupon and is movable outwardly with respect to the longitudinal axis. Optionally, the expandable reamer may include a plurality of generally radially and longitudinally extending lower bearing pads disposed axially below the plurality of blades and may include down-hole cutting structures carried thereupon.

The drilling system in accordance with embodiments of the invention may comprise a second expandable stabilizer axially coupled below the expandable reamer and may comprise a tubular body having a longitudinal axis and a drilling fluid flow path therethrough, and may include a plurality of generally radially and longitudinally extending lower bearing pads carried by the tubular body, wherein at least one lower bearing pad of the plurality of lower bearing pads includes down-hole cutting structure carried thereupon and is movable outwardly with respect to the longitudinal axis. The blades, the bearing pads and the lower bearing pads may be outwardly extensible with respect to the longitudinal axis by a fluid flow or pressure.

In still other embodiments of the invention, a stabilizer and reamer system for enlarging a borehole in a subterranean formation includes a tubular drill string assembly having a longitudinal axis, an upper segment, a mid segment and a drilling fluid flow path therethrough; at least one movable reamer blade carried by the mid segment; and at least one movable bearing pad carried by the upper segment having an up-hole edge and at least one trim cutting element thereon, wherein the at least one movable bearing pad is outwardly extensible with respect to the longitudinal axis by fluid flow or pressure. The upper segment and the mid segment may form a unitary portion of the tubular drill string assembly or may be individual assemblies making up the drilling assembly.

In further embodiments of the invention, a reamer-stabilizer system for enlarging a borehole in a subterranean formation comprising a portion of a drill string includes a longitudinal axis, an expandable reamer, an expandable stabilizer axially associated above the expandable reamer, and a drilling fluid flow path therethrough, where the expandable stabilizer includes a tubular body, and at least one bearing pad carried by the tubular body is outwardly extensible with respect to the longitudinal axis responsive to a pressure of drilling fluid passing through the drilling fluid flow path. The at least one bearing pad carries cutting structure thereon for up-hole trimming.

In still further embodiments of the invention, an assembly for trimming a subterranean borehole includes at least one laterally movable blade, and at least one laterally movable bearing pad longitudinally spaced above the at least one laterally movable blade and comprising at least one trimming element configured for up-hole drilling.

Methods for trimming a subterranean borehole may include positioning in a borehole, with a drill string, a first tubular body carrying at least one generally laterally movable blade and a second tubular body carrying at least one generally laterally movable bearing pad longitudinally spaced above the at least one laterally movable blade and comprising at least one trimming element configured for up drilling; moving the at least one generally laterally movable blade into contact with a wall of the borehole with a pressure or fluid flow from within the drill string; moving the at least one generally laterally movable bearing pad into contact with the wall of the borehole with the pressure or fluid flow from within the drill string; and rotating the drill string in the up-hole direction to trim formation material from the wall of the borehole.

Methods for trimming a subterranean borehole may also include positioning in the borehole, with the drill string, a third tubular body carrying at least one generally laterally second movable bearing pad longitudinally spaced below the at least one laterally movable blade and comprising at least one trimming element configured for down drilling, and moving the at least one generally laterally second movable bearing pad into contact with the wall of the borehole with the pressure or fluid flow from within the drill string.

Other advantages and features of the present invention will become apparent when viewed in light of the detailed description of the various embodiments of the invention when taken in conjunction with the attached drawings and appended claims.

DETAILED DESCRIPTION OF THE INVENTION

The illustrations presented herein are, in most instances, not actual views of any particular reamer tool, stabilizer tool, drill string, cutting element, or other feature of a stabilizer and reamer system of a drilling assembly, but are merely idealized schematic representations that are employed to describe the present invention. Additionally, elements common between figures may retain the same numerical designation. Moreover, the lateral and longitudinal dimensions shown in the figures are merely idealized representations, as the actual dimensions are expected to vary according to specific application requirements in the field.

Figure 1:
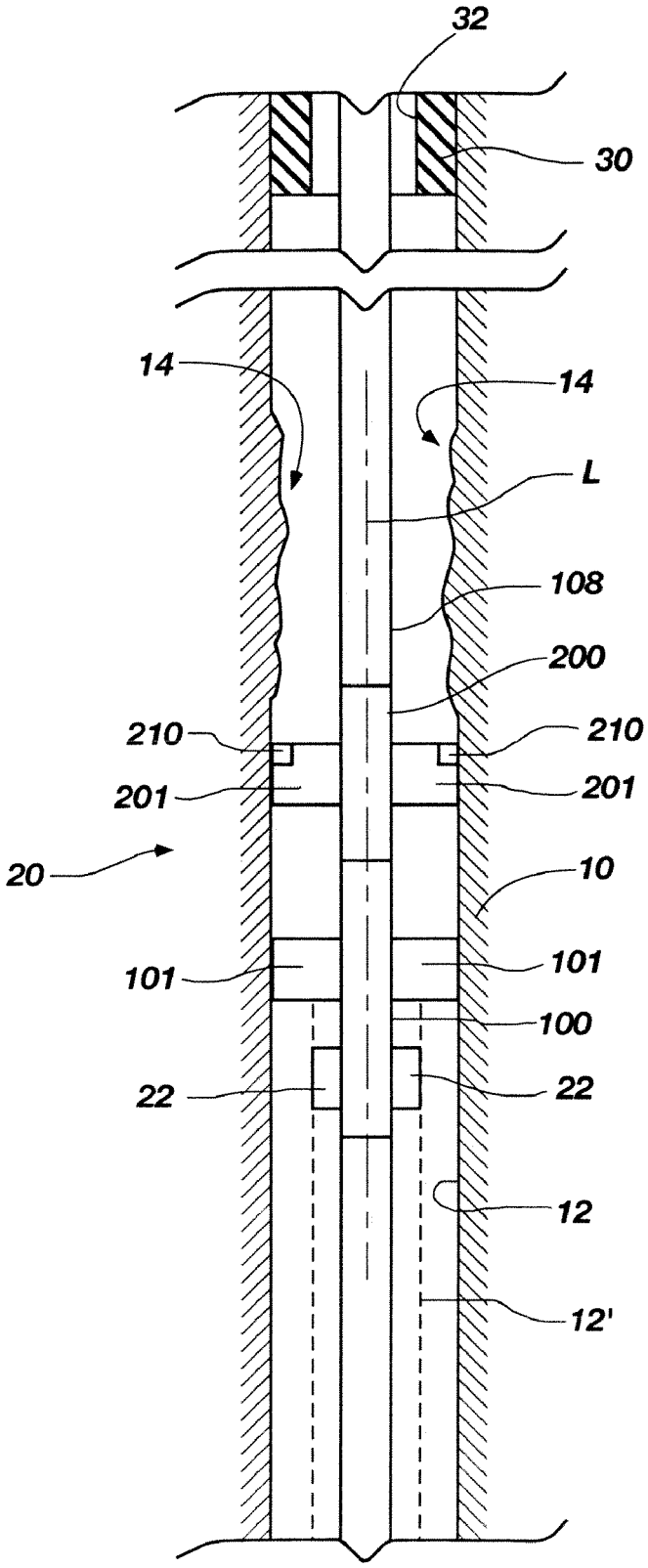
FIG. 1 is a longitudinal schematic view of a drilling assembly in accordance with an embodiment of the invention.

FIG. 1 is a longitudinal schematic view of a drilling assembly in accordance with an embodiment of the invention. A section of a drilling assembly generally designated by reference numeral 20 is shown reaming a borehole 12 extending through a formation 10 with an expandable reamer 100 followed by an expandable stabilizer 200. The expandable reamer 100 and the expandable stabilizer 200, respectively, include reamer blades 101 and bearing pads, or stabilizer blades 201 expanded to their full lateral extent for reaming and stabilizing the drilling assembly 20. The expandable stabilizer 200 may be adjacently located co-axially with the expandable reamer 100 in the drilling assembly 20 or separated by one or more drill pipe segments (not shown) in the drilling assembly 20. Optionally, the expandable reamer 100 and the expandable stabilizer 200 may comprise a single tool having a unitary body, of the drilling assembly 20. In any case, the expandable reamer 100 and the expandable stabilizer 200 are coupled together coaxially along a common central or longitudinal axis L of the drilling assembly 20. The expandable stabilizer 200 helps to control directional tendencies of the drilling assembly, reduce vibration, and stabilizes the expandable reamer 100 as the borehole 12 is reamed to a larger diameter beneath the smaller diameter borehole 32 of the casing or liner 30. This section of the drilling assembly 20 is shown having reamed the diameter of borehole 32 in the "down-hole" direction with the reamer blades 101 carrying cutting elements (not shown) thereon while being fully extended, and now back-reaming in the "up-hole" direction while the stabilizer blades 201, configured with cutting structures 210 on their up-hole surfaces, remove, by trimming, formation material from the wall of the borehole 12 while still providing stabilization for the drilling assembly 20. In this respect, the drilling assembly 20 provides capability for reaming while stabilizing in either direction within borehole 12 without having to retract respective blades 101 and 201 of the expandable reamer 100 and expandable stabilizer 200 in order to clear obstructions in the borehole 12, such as slump, swelled shale or filter cake, or other borehole obstructions and/or anomalies existing or occurring after reaming portions of the borehole 12.

Advantageously, the drilling assembly 20 of the present invention allows reaming and stabilizing to be provided in either direction without having to deactivate the expandable reamer 100 and the expandable stabilizer 200 in order to retract the blades 101 and 201, respectively, in order to get past a section of formation 10 encroaching on (i.e., by formation slumping, formation swelling, or caking upon the borehole wall) the previously reamed or drilled borehole 12. The formation slump or swell, or caking in borehole 12 is indicated generally by reference numeral 14. The drilling assembly 20 enables reaming in the down-hole direction and then back-reaming in the up-hole direction without having to deactivate the expandable stabilizer 200 in order to bypass formation irregularities (shown at reference numeral 14) in the borehole 12. Another advantage afforded with the drilling assembly 20 is the ability to ream and then back-ream without retraction of the stabilizer blades 201 to get past a restriction 14 in the borehole 12 of the formation 10, particularly when the expandable blades 101 and 201 of the expandable reamer 100 and the expandable stabilizer 200, respectively, are activated and deactivated by the same operational mechanism, such as hydraulic flow of drilling fluid through the flowbore (not shown) of the drilling assembly 20.

As also shown in FIG.1, the drilling assembly 20 may also include conventional fixed stabilizer blades or bearing pads 22 configured for allowing the drilling assembly 20 to pass through the borehole 32 of the casing 30 while sized to provide stabilization behind a drill bit (not shown) as it drills a smaller borehole 12' (shown in broken lines) than the expanded borehole 12 through the formation 10. Moreover, the fixed stabilizer blades or bearing pads 22 provide stabilizing support for expandable reamer 100 thereabove due to its presence in the smaller borehole 12' being drilled as the expandable reamer 100 enlarges the borehole diameter to that of borehole 12 when drilling in the down-hole direction through the smaller borehole 12', while the expandable stabilizer 200 provide stabilizing support for the expandable reamer 100 in the expanded borehole 12.

Figure 2:
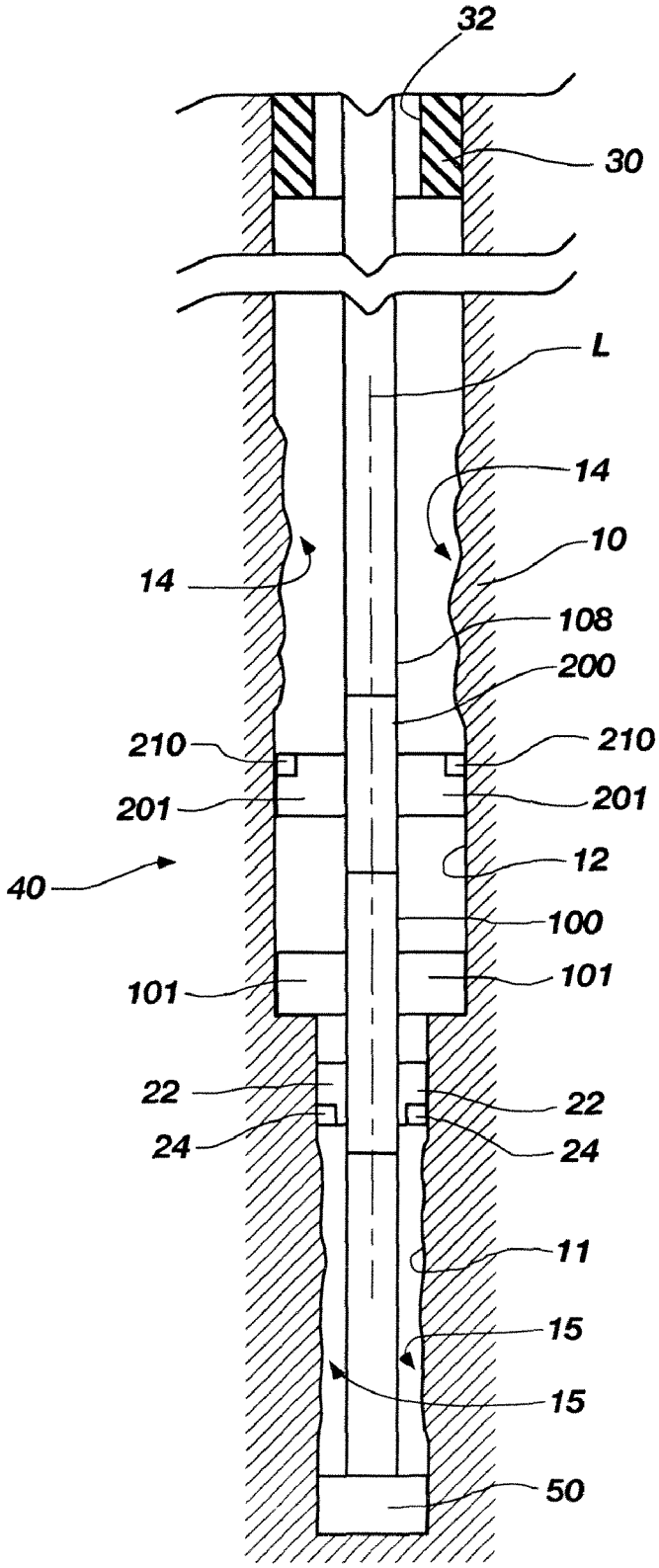
FIG. 2 is a longitudinal schematic view of a drilling assembly in accordance with another embodiment of the invention.

FIG. 2 shows a longitudinal schematic view of a drilling assembly 40 in accordance with another embodiment of the invention, wherein like reference numerals previously employed in FIG. 1 represent like components. A section of the drilling assembly 40 is shown reaming a formation 10 in the down-hole direction with an expandable reamer 100 followed by an expandable stabilizer 200, both the expandable reamer 100 and the expandable stabilizer 200, respectively, being expanded to their full lateral extent. The expandable stabilizer 200 helps to control directional tendencies or reduce vibrations of the drilling assembly 40 and stabilizes the expandable reamer 100 as the borehole 12 is enlarged to a larger diameter below a smaller diameter borehole 32 in the casing or liner 30. The section of the drilling assembly 40 is shown having enlarged the diameter of borehole 32 in the "down-hole" direction as the fully extended reamer blades 101 carrying cutting elements (not shown) removes the material of the formation, while the expandable reamer 100 is stabilized by the expandable stabilizer 200 making stabilizing contact with the wall of the larger borehole 12 as it follows the expandable reamer 100 and is further stabilized by fixed stabilizer blades or bearing pads 22 that are in stabilizing contact with the wall of the drilled borehole 11 below expandable reamer 100. As with the embodiment of the invention shown in FIG. 1, the stabilizer blades 201 of the expandable stabilizer 200 are configured with cutting structure 210 for removing, clearing, or trimming obstructions on the wall of the borehole 12 caused by the formation, such as slump, swelled shale or filter cake, or other anomalies reducing the size of or causing irregularities in the shape of the borehole 12 (generally referenced by numeral 14) when the drilling assembly 40 back reams the borehole 12.

Additionally, the fixed stabilizer blades or bearing pads 22 may be configured with cutting structure 24 upon its down-hole surfaces for removing or clearing obstructions (generally referenced by numeral 15) on the wall of the borehole 11 formed in the subterranean formation by the drill bit 50. The obstructions 15 may form as formation slump or swelled shale, or filter cake deposited upon the wall of the borehole 11 after the borehole 11 is drilled by the drill bit 50, or may comprise other anomalies in the borehole size or shape. In this embodiment, the cutting structure 24 upon the fixed stabilizer blades 22 provides for removal of obstructions 15 that may impede smooth passage as the fixed stabilizer blades 22 pass through the borehole 11 of formation 10 while providing stability desired for the expandable reamer 100 during the drilling and reaming operation. Moreover, the fixed stabilizer blades 22 are sized and configured for allowing the drilling assembly 40 to pass through the borehole 32 of the casing or liner 30 while also being sized and configured to provide stabilization behind a drill bit 50 as it drills a pilot borehole 11. In this respect, the fixed stabilizer blades 22 provide stabilizing support in the pilot borehole 11 for the expandable reamer 100 as it enlarges the borehole diameter to that of borehole 12 during down-hole drilling, while the expandable stabilizer 200 provides stabilizing support for the expandable reamer 100 in the expanded borehole 12, above the expandable reamer 100.

In other embodiments, the fixed stabilizer blades or bearing pads 22 may be designed and configured for allowing the drilling assembly 40 to pass through the borehole 32 of the casing or liner 30 while also being sized and configured to provide stabilization behind a drill bit 50 having a reduced lateral diameter as it drills a pilot borehole 11. In this respect, the drill bit 50 is undersized (however slightly) relative to the fixed stabilizers 22 in order to account for material washout caused by hydraulic fluid flowing about the drill bit 50. Thereby, allowing the fixed stabilizer 22 to make stabilizing contact with pilot borehole 11 drilled by the drill bit 50.

The expandable reamer 100 and/or the expandable stabilizer 200 of the drilling assembly 20 according to the embodiments of the invention as shown in FIG. 1 or 2 may include a generally cylindrical tubular body 108 having the longitudinal axis L. The tubular body 108 may have a lower end and an upper end. The terms "lower" and "upper," as used herein with reference to the ends, refer to the typical positions of the ends relative to one another when the drilling assembly is positioned within a well bore. The lower end of the tubular body 108 of the expandable reamer apparatus 100 may include a set of threads (e.g., a threaded male pin member) for connecting the lower end to another section of a drill string or another component of a bottom-hole assembly (BHA), such as, for example, a drill collar or collars carrying a pilot drill bit 50 (shown in FIG. 2) for drilling a well bore. Similarly, the upper end of the tubular body 108 of the expandable reamer apparatus 100 may include a set of threads (e.g., a threaded female box member) for connecting the upper end to another section of a drill string or another component of a bottom-hole assembly (BHA).

Typically, the expandable reamer 100 and the expandable stabilizer 200 may include a plurality of sliding cutter blocks or reamer blades 101 and a plurality of stabilizer blades or bearing pads 201, respectively, that are positionally retained in circumferentially spaced relationship in the tubular body 108 of the respective tool as further described below and may be provided at a position between the lower end and the upper end. The blades 101 and 201 may be comprised of steel, tungsten carbide, a particle-matrix composite material (e.g., hard particles dispersed throughout a metal matrix material), or other suitable materials as known in the art. The blades 101 and 201 are retained in an initial, retracted position within the tubular body 108 of the expandable reamer 100 and the expandable stabilizer 200, but may be moved responsive to application of hydraulic pressure into the extended position (shown in FIGS. 1 and 2) and moved back into a retracted position (not shown) when desired. The expandable reamer 100 and the expandable stabilizer 200 may be configured such that the blades 101 and 201, respectively, engage the walls of a subterranean formation surrounding a well bore in which drilling assembly 20 (or 40) is disposed to remove formation material when the blades 101 and 201 are in the extended position, but are not operable to so engage the walls of a subterranean formation within a well bore when the blades 101 and 201 are in the retracted position. While the expandable reamer 100 may conventionally include three reamer blades 101, it is contemplated that one, two or more than three blades may be utilized to improve performance in a given application. While the expandable stabilizer 200 may conventionally include three stabilizer blades 201, it is contemplated that one, two or more than three blades may be utilized to advantage. Moreover, in one embodiment, the blades 101 and 201 are symmetrically circumferentially positioned axial along the tubular body 108, and in other embodiments, the blades 101 and 201 may also be positioned circumferentially asymmetrically, as well as asymmetrically along the longitudinal axis L in the direction of either end.

Figure 3:
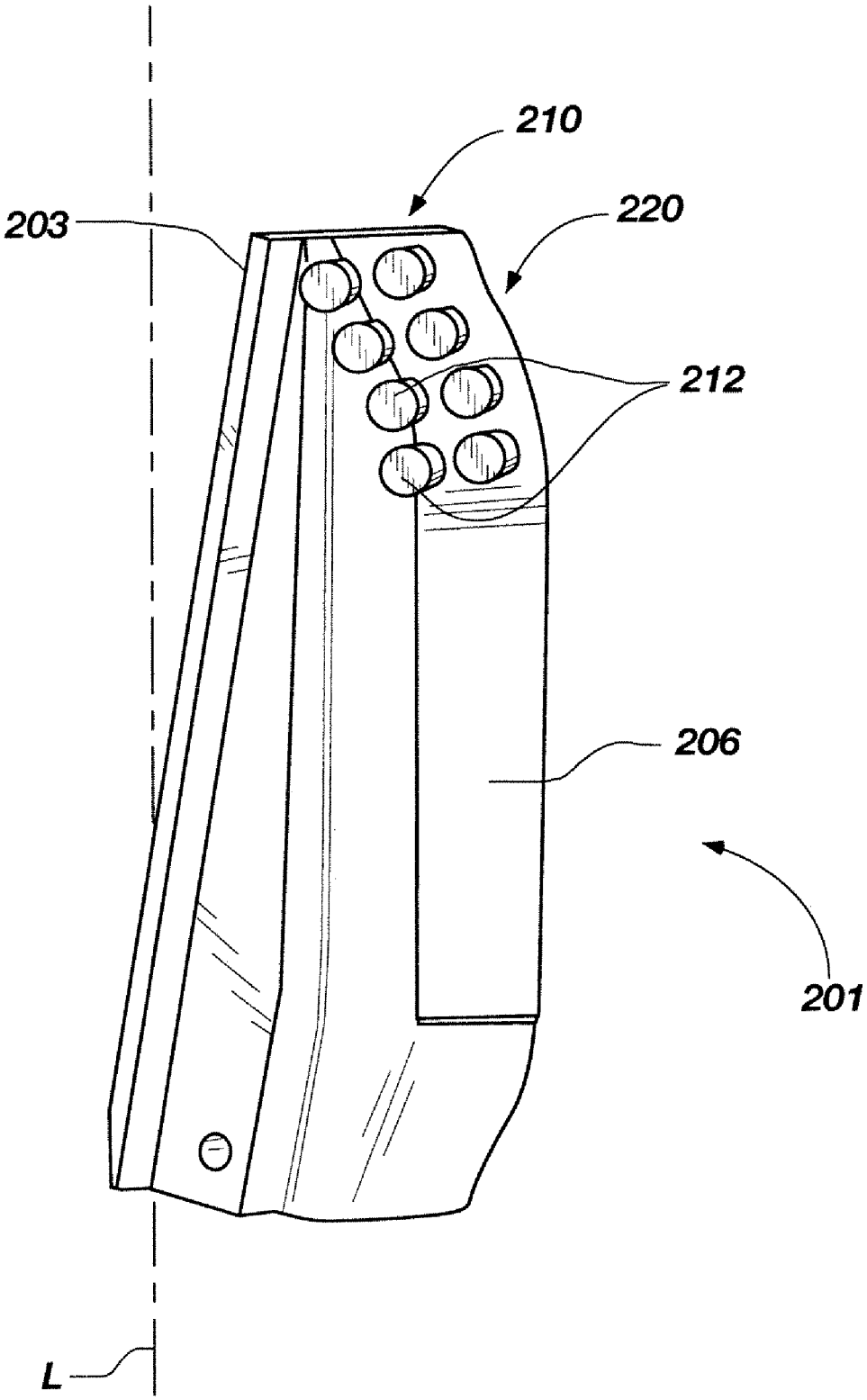
FIG. 3 is a longitudinal perspective view of a stabilizer blade suitable for use in accordance with embodiments of the invention.

The blades 101 and 201 of either of the expandable reamer 100 or the expandable stabilizer 200, respectively, may be operationally configured to extend or retract within the tubular body 108 as described in U.S. patent application Ser. No. 11/949,259, mentioned above, and the disclosure of which is incorporated herein in its entirety by this reference. Optionally, any conventional expandable reamer or expandable stabilizer modified and reconfigured in accordance with the teachings of the invention herein may be utilized to advantage to provide an improved system or drilling assembly for stabilizing the drill string while reaming, particularly when back reaming. For example, any one or all of the blades of such conventional reamer or stabilizer may be replaced with a stabilizer blade 201, as shown in FIG. 3, configured in accordance with the invention herein presented. Specifically, the stabilizer blade 201 is configured to extend laterally and axially outward upon the application of hydraulic fluid pressure flowing through the drilling assembly as provided for in the U.S. patent application Ser. No. 11/949,259, however, it is also recognized that the stabilizer blade 201 (or the reamer blade 101) may be configured for lateral outward extension by other hydraulic fluid pressure or by any other mechanical means, such as a push rod, wedge, or actuating motor or as conventionally understood to a person having ordinary skill in the expandable reamer/stabilizer art.

The stabilizer blade 201 as shown in FIG. 3 may include a rail 203 for engaging the blade tracks (shown in the incorporated reference) of the tubular body 108 allowing the stabilizer blade 201 to be extended outwardly and retracted inwardly into the drilling assembly 20 or 40 of FIGS. 1 and 2, respectively. The stabilizer blade 201 carries a plurality of cutting elements 212 comprising the cutting structure 210 configured upon an up-hole portion 220 thereof that are for engaging the material of a subterranean formation defining the wall of an open expanded borehole when the blades 101 and 201 (as described above with respect to FIGS. 1 and 2) are in an extended position. The cutting elements 212 may be polycrystalline diamond compact (PDC) cutters or other cutting elements known to a person of ordinary skill in the art and as generally described in U.S. Pat. No. 7,036,611 entitled "Expandable Reamer Apparatus for Enlarging Boreholes While Drilling and Methods of Use," the entire disclosure of which is incorporated by reference herein. While providing the cutting structure 210 upon the up-hole portion 220, the stabilizer blade 201 further comprises a bearing surface 206 for engaging the wall of the borehole during stabilization as is generally understood by a person of ordinary skill in the art. The cutting structure 210 may extend from the bearing surface 206 (i.e., at gage) radially and longitudinally inward on a portion of the up-hole portion 220 of the stabilizer blade 201. Generally, the bearing surface 206 is configured to be substantially parallel to the longitudinal axis L.

In other embodiments, a drilling system for enlarging a borehole in a subterranean formation is provided comprising an expandable reamer that includes a tubular body having a longitudinal axis and a drilling fluid flow path therethrough, a plurality of generally radially and longitudinally extending blades carried by the tubular body, and cutting structure carried by at least one blade of the plurality of blades, wherein at least one blade of the plurality of blades is movable outwardly with respect to the longitudinal axis; and an expandable stabilizer axially coupled above the expandable reamer and comprising a tubular body having a longitudinal axis and extending the drilling fluid flow path therethrough, a plurality of generally radially and longitudinally extending bearing pads carried by the tubular body, wherein at least one bearing pad of the plurality of bearing pads includes an up-hole cutting structure carried thereupon and is movable outwardly with respect to the longitudinal axis. Optionally, the expandable reamer may include a plurality of generally radially and longitudinally extending lower bearing pads disposed axially below the plurality of blades and may include down-hole cutting structures carried thereupon.

The drilling system in accordance with embodiments of the invention may comprise a second expandable stabilizer axially coupled below the expandable reamer and comprise a tubular body having a longitudinal axis and a drilling fluid flow path therethrough, a plurality of generally radially and longitudinally extending lower bearing pads carried by the tubular body, wherein at least one lower bearing pad of the plurality of lower bearing pads includes down-hole cutting structure carried thereupon and is movable outwardly with respect to the longitudinal axis. The blades, the bearing pads and the lower bearing pads may be outwardly extensible with respect to the longitudinal axis by a fluid flow or pressure.

In still other embodiments, a stabilizer and reamer system for enlarging a borehole in a subterranean formation includes a tubular drill string assembly having a longitudinal axis, an upper segment, a mid segment and a drilling fluid flow path therethrough; at least one movable reamer blade carried by the mid segment; and at least one movable bearing pad carried by the upper segment having an up-hole edge and at least one trim cutter element thereon, wherein the at least one movable bearing pad is outwardly extensible with respect to the longitudinal axis by fluid flow or pressure. The upper segment and the mid segment may form a unitary portion of the tubular drill string assembly or may be unitary assemblies making up the drilling assembly.

In further embodiments, a reamer-stabilizer system for enlarging a borehole in a subterranean formation comprising a portion of a drill string includes a longitudinal axis, an expandable reamer, an expandable stabilizer axially associated above the expandable reamer, and a drilling fluid flow path therethrough, wherein the expandable stabilizer includes a tubular body, and at least one bearing pad carried by the tubular body being outwardly extensible, with respect to the longitudinal axis, responsive to a pressure of drilling fluid passing through the drilling fluid flow path. The at least one bearing pad carries cutting structure thereon for up-hole trimming.

In still further embodiments, an assembly for trimming a subterranean borehole includes at least one laterally movable blade, and at least one laterally movable bearing pad longitudinally spaced above the at least one laterally movable blade and comprising at least one trimming element configured for up-hole drilling.

Methods for trimming a subterranean borehole may include positioning in a borehole, with a drill string, a first tubular body carrying at least one generally laterally movable blade and a second tubular body carrying at least one generally laterally movable bearing pad longitudinally spaced above the at least one laterally movable blade and comprising at least one trimming element configured for up drilling; moving the at least one generally laterally movable blade into contact with a wall of the borehole with a pressure or fluid flow from within the drill string; moving the at least one generally laterally movable bearing pad into contact with the wall of the borehole with the pressure or fluid flow from within the drill string; and rotating the drill string in the up-hole direction to trim formation material from the wall of the borehole.

Methods for trimming a subterranean borehole may also include substantially concurrently positioning a third tubular body, in the borehole, with the drill string, carrying at least one generally laterally second movable bearing pad longitudinally spaced below the at least one laterally movable blade and comprising at least one trimming element configured for down drilling, and moving the at least one generally laterally second movable bearing pad into contact with the wall of the borehole with the pressure or fluid flow from within the drill string.

While particular embodiments of the invention have been shown and described, numerous variations and other embodiments will occur to those skilled in the art. Accordingly, it is intended that the invention only be limited in terms of the appended claims and their legal equivalents.

What is claimed is:

1. A drilling system for enlarging a borehole in a subterranean formation, comprising:

an expandable reamer comprising a tubular body having a longitudinal axis and a drilling fluid flow path therethrough, a plurality of generally radially and longitudinally extending blades carried by the tubular body, and cutting structure carried by at least one blade of the plurality of blades, wherein at least one blade of the plurality of blades is movable outwardly with respect to the longitudinal axis; and an expandable stabilizer axially above the expandable reamer and comprising a tubular body having a longitudinal axis and a drilling fluid flow path therethrough, a plurality of generally radially and longitudinally extending bearing pads carried by the tubular body, wherein at least one bearing pad of the plurality of bearing pads includes up-hole cutting structure positioned on an up-hole portion of the at least one bearing pad and a bearing surface extending from the up-hole cutting structure to a down-hole portion of the at least one bearing pad, the up-hole cutting structure being movable outwardly with respect to the longitudinal axis.

2. The drilling system of claim 1, wherein the up-hole cutting structure comprises a plurality of PDC cutting elements.

3. The drilling system of claim 1, wherein the expandable reamer further comprises a plurality of generally radially and longitudinally extending lower bearing pads disposed axially below the plurality of blades.

4. The drilling system of claim 3, wherein at least one lower bearing pad of the plurality of lower bearing pads includes down-hole cutting structure carried thereupon.

5. The drilling system of claim 3, wherein at least one lower bearing pad of the plurality of lower bearing pads is movable outwardly with respect to the longitudinal axis.

6. The drilling system of claim 1, further comprising a second expandable stabilizer axially below the expandable reamer and comprising a tubular body having a longitudinal axis and a drilling fluid flow path therethrough, a plurality of generally radially and longitudinally extending lower bearing pads carried by the tubular body, wherein at least one lower bearing pad of the plurality of lower bearing pads includes down-hole cutting structure carried thereupon and is movable outwardly with respect to the longitudinal axis.

7. The drilling system of claim 6, wherein the at least one blade, the at least one bearing pad and the at least one lower bearing pad are each outwardly extensible with respect to the longitudinal axis by a fluid flow or pressure.

8. A stabilizer and reamer system for enlarging a borehole in a subterranean formation, comprising:

a tubular drill string assembly having a longitudinal axis, an upper segment, a mid segment and a drilling fluid flow path therethrough;

at least one movable reamer blade carried by the mid segment;

at least one movable bearing pad carried by the upper segment having an up-hole edge carrying at least one trim cutter element thereon for selective engagement with a formation upon rotation of the tubular drill string assembly, wherein the at least one movable bearing pad is outwardly extensible with respect to the longitudinal axis by fluid flow or pressure; and at least one lower bearing pad carried by a lower segment of the tubular drill string assembly below the at least one movable reamer blade of the mid segment, wherein the at least one lower bearing pad comprises a down-hole portion having at least one trim cutter element positioned thereon for selective engagement with a formation upon rotation of the tubular drill string assembly.

9. The stabilizer and reamer system of claim 8, wherein the upper segment and the mid segment form a unitary portion of the tubular drill string assembly.

10. The stabilizer and reamer system of claim 8, wherein the at least one lower bearing pad comprises a plurality of lower bearing pads carried by the lower segment of the tubular drill string assembly below the at least one movable reamer blade of the mid segment.

11. The stabilizer and reamer system of claim 8, wherein the mid segment and the lower segment form a unitary portion of the tubular drill string assembly.

12. The stabilizer and reamer system of claim 8, wherein the at least one lower bearing pad is a fixed lower stabilizing bearing pad.

13. The stabilizer and reamer system of claim 8, wherein the at least one movable bearing pad carried by the upper segment comprises a bearing surface extending from an up-holeportion of the at least one movable bearing pad to a down-hole portion of the at least one movable bearing pad and is positioned substantially parallel to the longitudinal axis of the tubular drill string.

14. The stabilizer and reamer system of claim 8, wherein the at least one trim cutter element is a PDC cutting element.

15. The stabilizer and reamer system of claim 8, wherein the at least one movable reamer blade and the at least one movable bearing pad are each outwardly extensible with respect to the longitudinal axis by a fluid flow or pressure.

16. A reamer-stabilizer system for enlarging a borehole in a subterranean formation, comprising:

a drill string portion comprising:

a longitudinal axis;

an expandable reamer;

an expandable stabilizer axially associated above the expandable reamer; and a drilling fluid flow path extending through the expandable reamer and the expandable stabilizer, the expandable stabilizer comprising:

a tubular body; and at least one bearing pad carried by the tubular body being outwardly extensible with respect to the longitudinal axis responsive to a pressure of drilling fluid passing through the drilling fluid flow path, wherein the at least one bearing pad carries cutting structure thereon positioned on an up-hole portion of the at least one bearing pad for up-hole trimming and wherein the at least one bearing pad includes a bearing surface extending from the cutting structure to a down-hole portion of the at least one bearing pad.

17. The reamer-stabilizer system of claim 16, wherein the expandable reamer comprises a tubular body, at least one blade carried by the tubular body being outwardly extensible with respect to the longitudinal axis responsive to the pressure of drilling fluid passing through the drilling fluid flow path, wherein the at least one blade carries cutting structure for reaming.

18. The reamer-stabilizer system of claim 17, wherein the at least one blade and the at least one bearing pad are each outwardly extensible to the same extent.

19. An assembly for trimming a subterranean borehole, comprising:

at least one laterally movable blade; and at least one laterally movable bearing pad longitudinally spaced above the at least one laterally movable blade and comprising:

at least one trimming element configured for up-hole drilling and positioned on an up-hole portion of the at least one laterally movable bearing pad; and a bearing surface positioned adjacent to the cutting structure, a down-hole portion of the bearing surface being substantially devoid of cutting structure.

20. The assembly of claim 19, wherein the at least one laterally movable blade and the at least one laterally movable bearing pad are movable to substantially same lateral extents in response to drilling fluid pressure within the assembly.

21. A method for trimming a subterranean borehole, comprising:

positioning in a borehole, with a drill string, a first tubular body carrying at least one generally laterally movable blade and a second tubular body carrying at least one generally laterally movable bearing pad longitudinally spaced above the at least one laterally movable blade and comprising at least one trimming element configured for up drilling;

moving the at least one generally laterally movable blade into contact with a wall of the borehole with a pressure or fluid flow from within the drill string;

moving the at least one generally laterally movable bearing pad into contact with the wall of the borehole with the pressure or fluid flow from within the drill string; and rotating the drill string in the up-hole direction to trim formation material from the wall of the borehole with an up-hole cutting structure positioned on the at least one generally laterally movable bearing pad and to contact the wall of the borehole with a bearing surface on the at least one generally laterally movable bearing pad extending from the up-hole cutting structure to a down-hole portion of the at least one generally laterally movable bearing pad.

22. The method of claim 21, further comprising substantially concurrently positioning in the borehole, with the drill string, a third tubular body carrying at least one generally laterally second movable bearing pad longitudinally spaced below the at least one laterally movable blade and comprising at least one trimming element configured for down drilling, and moving the at least one generally laterally second movable bearing pad into contact with the wall of the borehole with the pressure or fluid flow from within the drill string.

* * * * *

UNITED STATES PATENT AND TRADEMARK OFFICE

CERTIFICATE OF CORRECTION

PATENT NO. : 7,882,905 B2
APPLICATION NO. : 12/058384
DATED : February 8, 2011
INVENTOR(S) : Steven R. Radford et al.

It is certified that error appears in the above-identified patent and that said Letters Patent is hereby corrected as shown below:

On the title page:

In ITEM (56) References Cited

U.S. PATENT DOCUMENTS

Page 2, 1st column, 19th entry, change "Schillilnger" to --Schillinger--

In the specification:

| | | |
|---|---|---|
| COLUMN 2, | LINE 9, | change "permit greater" to --permits greater-- |
| COLUMN 2, | LINE 31, | change "Warren." to --Warren et al.-- |
| COLUMN 8, | LINE 49, | change "drilling assembly **20**" to --drilling assembly **20** or **40**-- |

In the claims:

| | |
|---|---|
| CLAIM 13, COLUMN 13, LINES 6,7 | change "an up-holeportion" to --an up-hole portion-- |
| CLAIM 19, COLUMN 14, LINES 10,11 | change "to the cutting structure," to --to the at least one trimming element,-- |
| CLAIM 19, COLUMN 14, LINE 12 | change "cutting structure." to --trimming elements.-- |

Signed and Sealed this
Third Day of January, 2012

David J. Kappos

David J. Kappos
*Director of the United States Patent and Trademark Office*